US009926760B1

(12) United States Patent
Santilli et al.

(10) Patent No.: US 9,926,760 B1
(45) Date of Patent: Mar. 27, 2018

(54) SUBSEA TREE CAP SYSTEM DEPLOYABLE VIA REMOTELY OPERATED VEHICLE

(71) Applicant: OneSubsea IP UK Limited, London (GB)

(72) Inventors: Claudio Santilli, Houston, TX (US); Kris Andrew Cabral, Houston, TX (US)

(73) Assignee: OneSubsea IP UK Limited, Sugar Land, TX (US)

( * ) Notice: Subject to any disclaimer, the term of this patent is extended or adjusted under 35 U.S.C. 154(b) by 0 days.

(21) Appl. No.: 15/486,075

(22) Filed: Apr. 12, 2017

(51) Int. Cl.
*E21B 33/035* (2006.01)
*G05D 1/00* (2006.01)

(52) U.S. Cl.
CPC ..... *E21B 33/035* (2013.01); *G05D 1/0011* (2013.01)

(58) Field of Classification Search
CPC ..... E21B 33/035; G05D 1/0011
See application file for complete search history.

(56) References Cited

U.S. PATENT DOCUMENTS 5,992,526 A * 11/1999 Cunningham ..... E21B 33/035 166/343
6,474,416 B2 * 11/2002 Beall ..... E21B 33/037 166/343
7,325,598 B2 * 2/2008 Bartlett ..... E21B 33/038 166/360
7,490,673 B2 * 2/2009 Bartlett ..... E21B 33/038 166/339
7,621,338 B2 * 11/2009 Wenham ..... E21B 33/035 166/343
7,677,319 B2 * 3/2010 Baskett ..... E21B 33/035 166/360
8,087,465 B2 * 1/2012 Huang ..... E21B 33/037 166/339
8,230,928 B2 * 7/2012 Cuiper ..... E21B 33/035 138/89
8,739,883 B2 * 6/2014 Aarnes ..... E21B 23/02 166/351
8,950,474 B2 * 2/2015 Kekarainen ..... E21B 23/01 166/339
9,057,238 B2 * 6/2015 Shaw ..... E21B 33/035
2014/0060849 A1 * 3/2014 Pathak ..... E21B 33/037 166/344
2015/0034338 A1 * 2/2015 Lim ..... E21B 33/035 166/386

FOREIGN PATENT DOCUMENTS

GB 2401887 A * 11/2004 ..... E21B 33/035

* cited by examiner

*Primary Examiner* — Matthew R Buck
(74) *Attorney, Agent, or Firm* — Rodney Warfford; Bob Van Someren

(57) ABSTRACT

A technique facilitates use and operation of a tree cap which may be deployed into engagement with a subsea tree located over a subsea well. The subsea tree may comprise a production flow passage and an annulus flow passage in communication with a tree cap receiving area. The tree cap may be moved via a remotely operated vehicle (ROV) into position in the tree cap receiving area. The ROV also may be operated to selectively lock and/or release the tree cap with respect to its position in the subsea tree.

15 Claims, 7 Drawing Sheets

SUBSEA TREE CAP SYSTEM DEPLOYABLE VIA REMOTELY OPERATED VEHICLE

BACKGROUND

Hydrocarbon fluids such as oil and natural gas are obtained from a subterranean geologic formation, referred to as a reservoir, by drilling a well that penetrates the hydrocarbon-bearing geologic formation. In subsea applications, the well is drilled at a subsea location and the flow of fluids may be handled by several different types of equipment. In subsea operations, for example, the subsea equipment may comprise subsea completion systems which may include or work in cooperation with subsea installations mounted over a wellhead. The subsea installations may comprise various components, e.g. subsea trees, and may incorporate fluid flow paths, e.g a production flow path and an annulus flow path. Tree caps are placed on the subsea tree to cap off flow passages within the subsea tree and to provide a final barrier with respect to the surrounding environment.

SUMMARY

In general, a system and methodology utilize a tree cap which may be deployed into engagement with a subsea tree located over a subsea well. The subsea tree may comprise a production flow passage and an annulus flow passage in communication with a tree cap receiving area. The tree cap may be moved via, for example, a remotely operated vehicle (ROV) into position in the tree cap receiving area. The ROV also may be operated to selectively lock and/or release the tree cap with respect to its position in the subsea tree.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
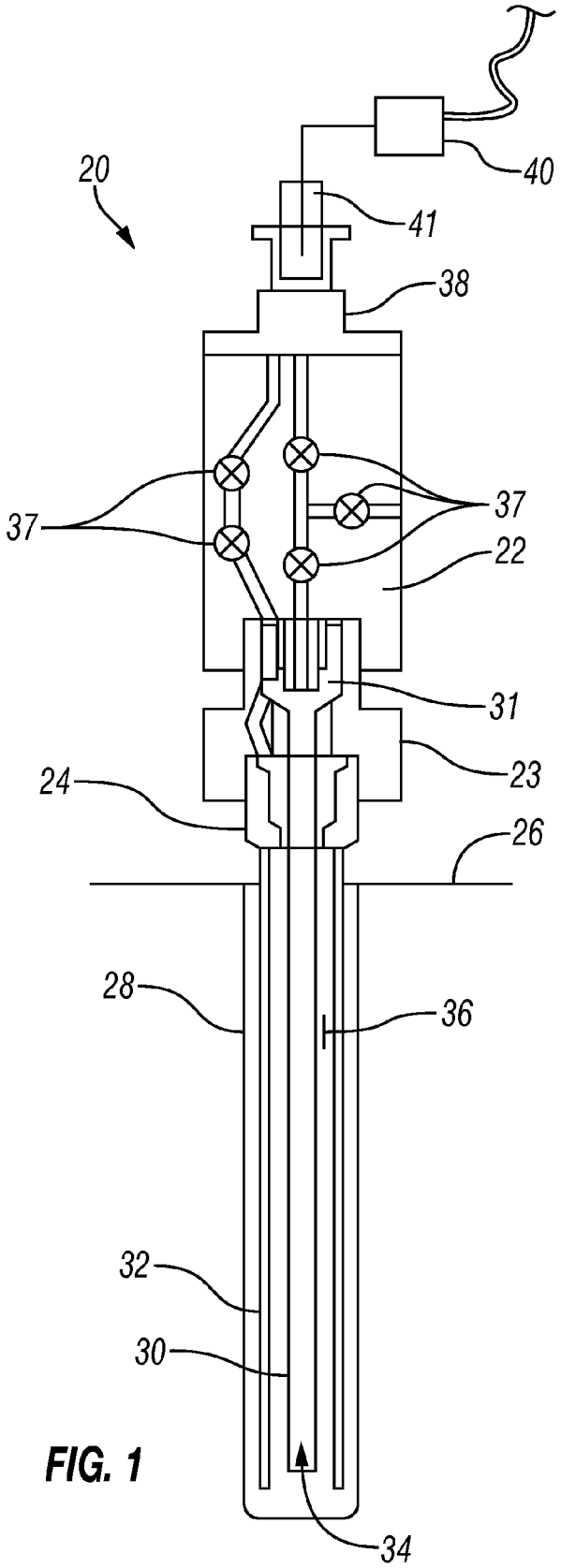
FIG. 1 is a schematic illustration of an example of a well system deployed at a subsea location and comprising a subsea tree combined with a tree cap, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology utilizing a tree cap which may be deployed into engagement with a subsea tree located over a subsea well. In some subsea operations, the subsea well comprises production tubing disposed within well casing and this arrangement forms a production flow passageway within the production tubing and an annulus flow passageway between the production tubing and the surrounding casing. The subsea tree may comprise a corresponding production flow passage and a corresponding annulus flow passage which are in communication with a tree cap receiving area. The tree cap may be constructed with a size and configuration to facilitate movement of the tree cap via a remotely operated vehicle (ROV), e.g. movement into position in the tree cap receiving area. The ROV also may be operated to selectively lock and/or release the tree cap with respect to its position in the subsea tree.

The ROV deployable tree cap provides a combined production and annulus barrier. In some embodiments, the tree cap may be installed on top of the corresponding subsea tree in an open sea with the ROV. A wire and/or buoyancy feature may be used to facilitate carrying of the tree cap via the ROV through the open sea. According to an embodiment, the tree cap has mechanical features arranged so that once landed in the subsea tree the tree cap may be actuated via the ROV. For example, the tree cap may comprise an ROV torque interface with a corresponding bucket to enable rotation of an ROV operated mechanism of the tree cap. Rotation of this mechanism may be used to, for example, lock the tree cap with respect to the subsea tree and also to set seals between the tree cap and subsea tree. In some applications, this approach may be used to enable the system to apply a pre-load to the locking mechanism.

In some embodiments, the tree cap may be combined with a tree cap installation and retrieval assembly which facilitates installation, retrieval, and/or reinstallation of the tree cap. By way of example, the installation and retrieval assembly may comprise a removable external guide funnel which helps prevent damage to seals and gasket prep during installation and/or retrieval of the tree cap. The installation and retrieval assembly also may comprise a removable lifting bail by which the tree cap is moved to or away from the subsea tree. Features such as the removable external guide funnel and removable lifting bail enable the tree cap system to be retrieved or re-installed within a riser, for example, using appropriately designed tools. It should be noted the tree cap and/or installation and retrieval assembly also may be constructed to provide protection against debris and/or corrosion and may include corrosion inhibitor injection features. Effectively, the tree cap incorporates the function of debris cap with or without corrosion inhibitor injection.

The tree cap may be constructed to effectively seal the concentric production passageway and annulus passageway formed by the production tubing and well casing to selectively isolate the production and annulus passageways. As described in greater detail below, embodiments of the tree cap may be selectively locked and unlocked via engagement with a recess(s), e.g. a groove, in the subsea tree. An example comprises grooves in a tree master block of the subsea tree. The locking and unlocking may be achieved by rotation and reverse rotation of the ROV torque interface. In some embodiments, the tree cap also may comprise an emergency release mechanism which enables release of the tree cap from the subsea tree via a straight overpull. In embodiments described below, the tree cap is illustrated as deployed into engagement with a vertical subsea tree but the tree cap also may be used with horizontal subsea tree systems.

Referring generally to FIG. 1, an example of a subsea well system 20 for use in a well operation is illustrated. The subsea well system 20 may comprise a variety of components, such as a subsea tree 22, e.g. a vertical subsea tree, mounted on a tubing head spool 23 positioned over a wellhead 24 at a subsea surface/mudline 26. The wellhead 24 may be positioned over a well 28 in which production tubing 30 is suspended from a tubing hanger 31 located at tubing head spool 23. In the illustrated example, the production tubing 30 and a well casing 32 establish flow passages, such as a subsurface production flow passage 34 and an annulus flow passage 36. The production flow passage 34 and the annulus flow passage 36 are continued up through subsea tree 22 and fluid flow therethrough may be controlled via valves 37, e.g. annulus gate valves and production gate valves. In some wells 28, the annulus flow passage 36 is between the production tubing 30 and well casing 32 and is concentrically located about the production flow passage 34 within production tubing 30. In the embodiment illustrated, the subsea well system 20 also comprises a tree cap 38 which may be releasably deployed into engagement with the subsea tree 22 via a remotely operated vehicle (ROV) 40 having an ROV manipulator 41.

Figure 2:
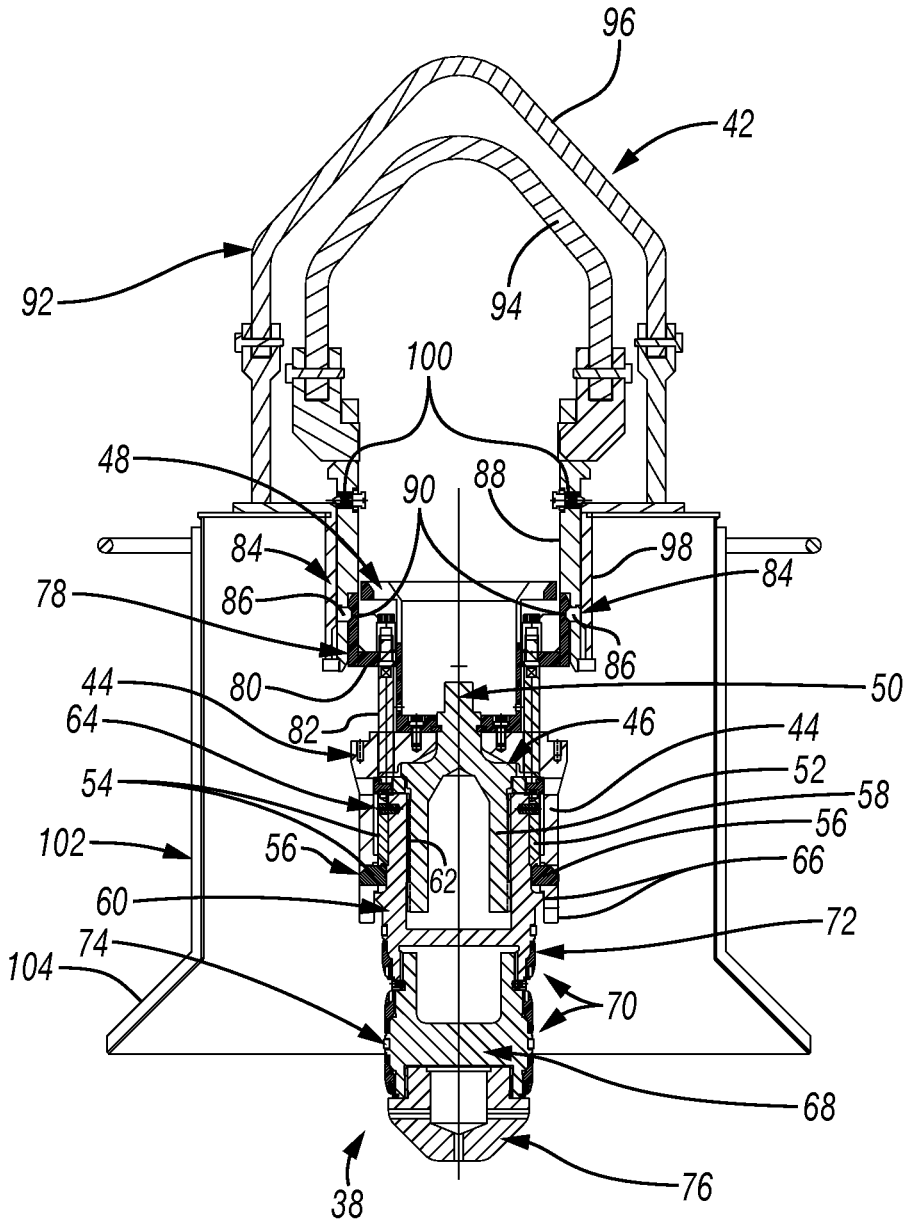
FIG. 2 is a cross-sectional illustration of an example of a tree cap, according to an embodiment of the disclosure.

Referring generally to FIG. 2, an embodiment of tree cap 38 is illustrated as coupled with a tree cap installation and retrieval assembly 42. In this example, tree cap 38 comprises an outer body 44 to which an ROV operated stem mechanism 46 is coupled. By way of example, the ROV operated mechanism 46 may be rotatably mounted through an upper portion of the outer body 44. In the illustrated embodiment, the ROV operated mechanism 46 also extends into an ROV bucket 48 sized to receive ROV manipulator 41, e.g. a rotational torquing tool, of the ROV 40.

According to an embodiment, the ROV operated mechanism 46 comprises an ROV interface 50 which may be in the form of a drive stem or other feature suitable for operative coupling with the ROV manipulator 41. In the illustrated embodiment, the ROV operated mechanism 46 further comprises a power screw 52 disposed in an interior of outer body 44. The ROV operated mechanism 46 also interacts with locking features 54 which may comprise locking dogs 56 acted on by a locking member 58, such as a locking actuator ring. The locking features 54 enable selective locking of the tree cap 38 with the subsea tree 22, as described in greater detail below.

Depending on the specifics of the corresponding equipment and capping application, the ROV operated mechanism 46 and corresponding locking features 54 may be constructed in various forms with different types of components. In the illustrated example, however, the ROV operated mechanism 46 comprises power screw 52 which is coupled with locking features 54, e.g. with locking member 58, via a primary seal mandrel 60, e.g. an upper seal mandrel. For example, the power screw 52 may be threadably engaged with an interior of primary seal mandrel 60 via a threaded engagement region 62.

In this embodiment, the locking member 58, e.g. locking actuator ring, is coupled to the primary seal mandrel 60 along an exterior of the primary seal mandrel 60 via a shear member 64, e.g. shear pins. Thus, upon rotation of power screw 52 via ROV ROV interface 50 powered by ROV 40, the primary seal mandrel 60 and the locking member 58 are moved with respect to outer body 44, e.g. driven downwardly with respect outer body 44. As illustrated, the locking dogs 56 may be transversely and slidably mounted in outer body 44 for engagement by locking member 58 as the locking member 58 is driven via rotation of power screw 52. In some embodiments, the outer body 44 may comprise engagement features 66, e.g. castellations, abutments, or other engagement features which prevent relative rotation between outer body 44 and primary seal mandrel 60 as well as between outer body 44 and the corresponding subsea tree 22.

For some operations, the tree cap 38 also may comprise a secondary seal mandrel 68, e.g. a lower seal mandrel. As illustrated, the primary/upper seal mandrel 60 and/or secondary/lower seal mandrel 68 comprise a seal system 70 positioned to form a desired seal with an interior of the subsea tree 22 as described in greater detail below. In the illustrated example, the seal system 70 may comprise an upper mandrel seal 72 positioned around the upper seal mandrel 60. If the lower seal mandrel 68 is employed, a lower mandrel seal 74 may be positioned around the lower seal mandrel 68. Each of the seals 72, 74 may comprise an individual seal or a plurality of seals in the form of metal-to-metal seals, thermoplastic seals, various types of elastomeric seals, or other suitable seals. By way of example, the upper mandrel 60 may be coupled to lower mandrel 68 via a threaded engagement or by other suitable coupling techniques. In some embodiments, the tree cap 38 also may comprise a guidance nose 76 to centralize the tree cap 38 during installation so as to protect the seals 72, 74 as they move into the subsea tree 22 while also protecting the gasket prep on subsea tree 22.

The tree cap 38 also may comprise an override system 78 which can be used to unlock the tree cap 38 from the subsea tree 22 if the tree cap is not able to be released via the ROV operated mechanism 46. The override system 78 may comprise a coupling mechanism 80 connected to an override rod or rods 82. The override rods 82, in turn, are mechanically connected to the locking actuator member 58. By applying a sufficient pull force to the coupling mechanism 80, the override rods 82 are able to sufficiently pull locking member 58 so as to shear the shear member 64. Once the shear member 64 is sheared, the locking member 58, e.g. locking ring, is pulled out of engagement with locking dogs 56 and the tree cap 38 is released from engagement with the surrounding subsea tree 22.

The tree cap installation and retrieval assembly 42 may be releasably coupled with the tree cap 38 to facilitate installation and/or retrieval of the tree cap 38. For example, the assembly 42 enables running and setting of the tree cap 38 into the subsea tree 22 via the ROV manipulator 41 and/or lift land. The assembly 42 also may be configured to enable unlocking of the tree cap 38 from the subsea tree 22 via at least one release mechanism. Depending on the parameters of a given application, the tree cap installation and retrieval assembly 42 may comprise various components in several configurations.

According to an embodiment, the tree cap installation and retrieval assembly 42 may be releasably coupled with the tree cap 38 via a release mechanism 84, such as a spring-loaded release mechanism or other suitable mechanism. By way of example, the release mechanism 84 may comprise pins 86 movably mounted in an assembly housing 88 and oriented for engagement with corresponding features 90, e.g. grooves or other types of recesses, formed in tree cap 38. In the illustrated example, the corresponding features 90 comprise recesses formed along the exterior of coupling mechanism 80. Depending on the construction of installation and retrieval assembly 42, the pins 86 may comprise spring-loaded pins biased toward engagement with corresponding features 90.

The installation and retrieval assembly 42 may comprise a bail system 92 constructed to facilitate movement of assembly 42 and tree cap 38 via, for example, ROV 40 and/or a lift line. Depending on the parameters of a given operation, bail system 92 may comprise a single bail or a plurality of bails such as inner bail 94 and outer bail 96. In the example illustrated, lifting outer bail 96 causes an outer assembly housing 98 to slide upwardly with respect to assembly housing 88 until pins 86 are released from corresponding features 90. This allows the tree cap installation and retrieval assembly 42 to be lifted away from the tree cap 38. A resistance mechanism 100, e.g. shear members, may be used to provide an initial resistance to sliding of outer assembly housing 98 with respect to assembly housing 88.

The inner bail 94 may be used to release the tree cap 38 by enabling an over pull force to be applied so as to shear the shear member 64 as described above. In this situation, the inner bail 94 is lifted while the outer assembly housing 98 remains in place so as to secure pins 86 in corresponding features 90. Consequently, a substantial pulling force may be applied to the tree cap 38 via the tree cap installation and retrieval assembly 42.

In some embodiments, the assembly 42 may comprise an external guide funnel 102. The external guide funnel 102 is sized and oriented to externally engage the subsea tree 22 and to guide the tree cap 38 into the subsea tree 22 during installation. As illustrated, the external guide funnel 102 may comprise a lower flared portion 104 to facilitate engagement with the subsea tree 22 and proper alignment of the tree cap 38. The external guide funnel 102 may be used in cooperation with guidance nose 76 to ensure proper installation of the tree cap 38 without damaging seals 72, 74 or gasket prep on subsea tree 22. It should be noted the geometry of subsea tree 22 further enables the system to interface with a workover system in a manner which allows selective injection of fluids through the annulus passage and/or production passage.

Figure 3:
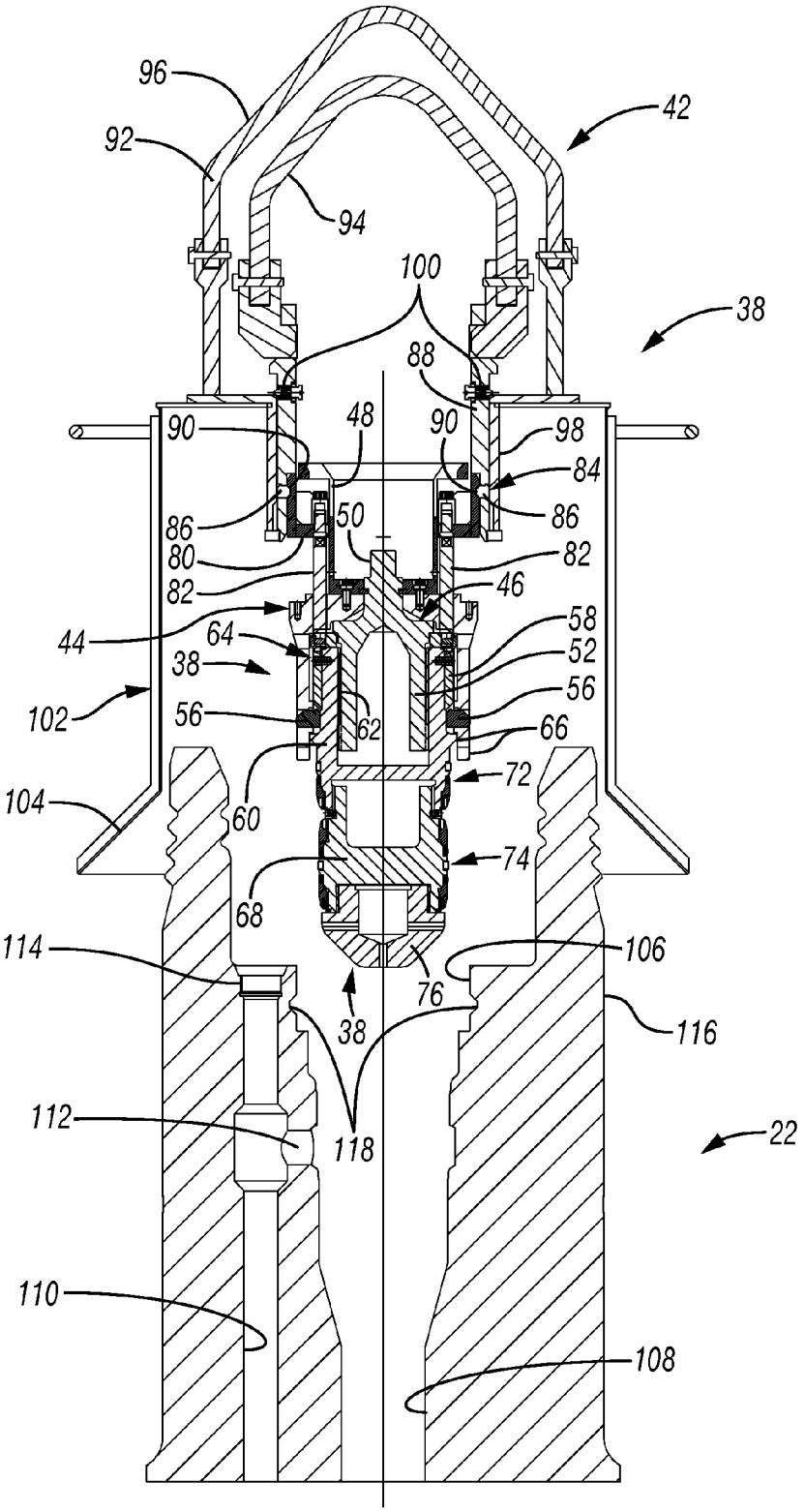
FIG. 3 is an illustration of an example of a tree cap being deployed into engagement with a corresponding subsea tree, according to an embodiment of the disclosure.

Referring generally to FIG. 3, an operational example is illustrated in which the tree cap 38 is approaching subsea tree 22 while being installed into the corresponding subsea tree 22. In this example, the subsea tree 22 comprises a tree cap receiving area 106 which is in communication with a production passage 108 within the subsea tree 22. The tree cap receiving area 106 also is in communication with an annulus passage 110 via, for example, a crossover port 112. In some embodiments, an upper portion of the annulus passage 110 is closed off by a plug 114, e.g. a welded plug. The production passage 108 in subsea tree 22 is in fluid communication with well production passage 34, and annulus passage 110 is in fluid communication with well annulus passage 36. The tree cap 38 is sized for receipt in tree cap receiving area 106 and may be deployed into position via ROV 40 coupled with bail system 92 or via other suitable techniques.

Figure 4:
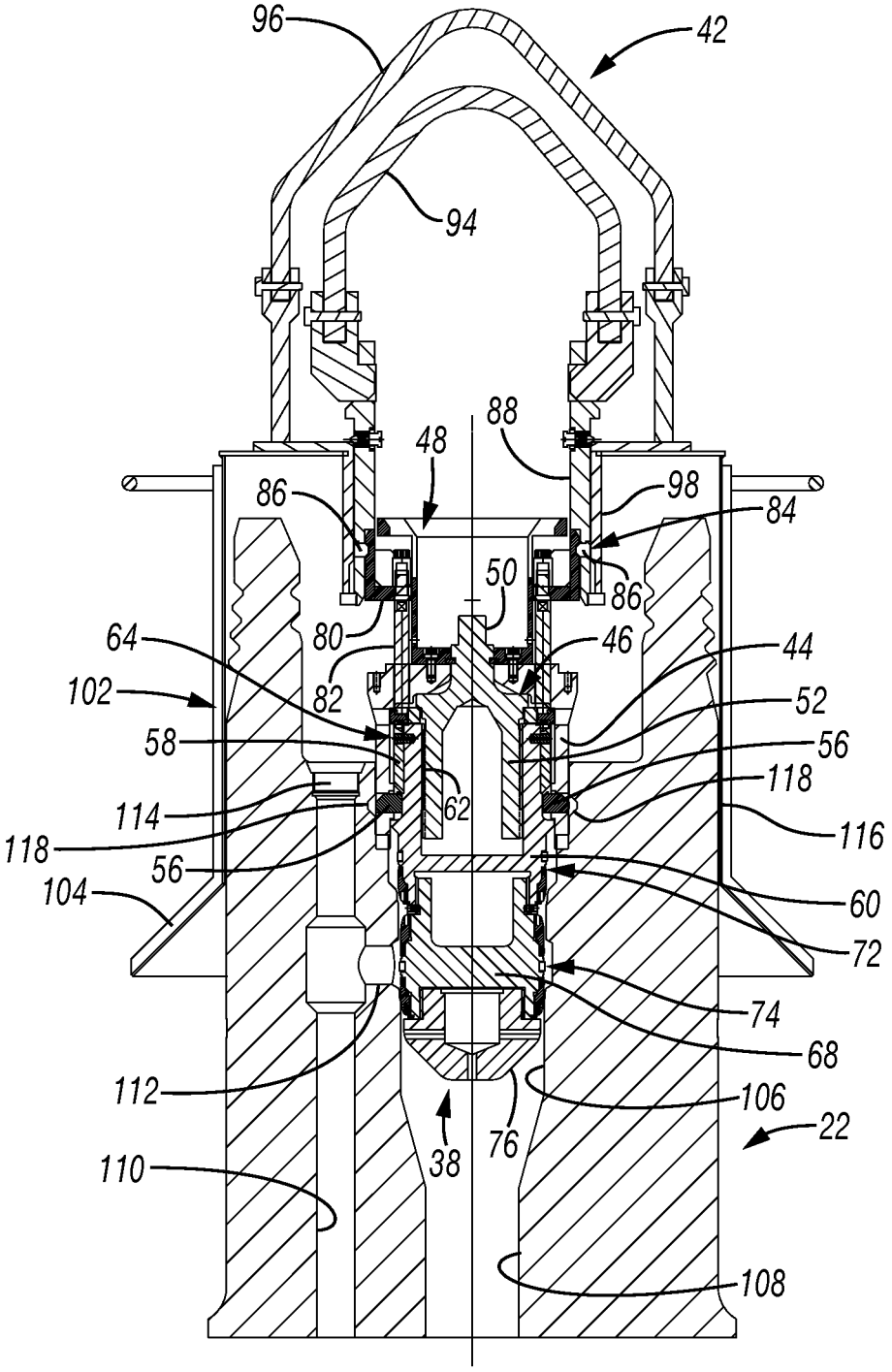
FIG. 4 is an illustration similar to that of FIG. 3 but during a different stage of deployment, according to an embodiment of the disclosure.
Figure 5:
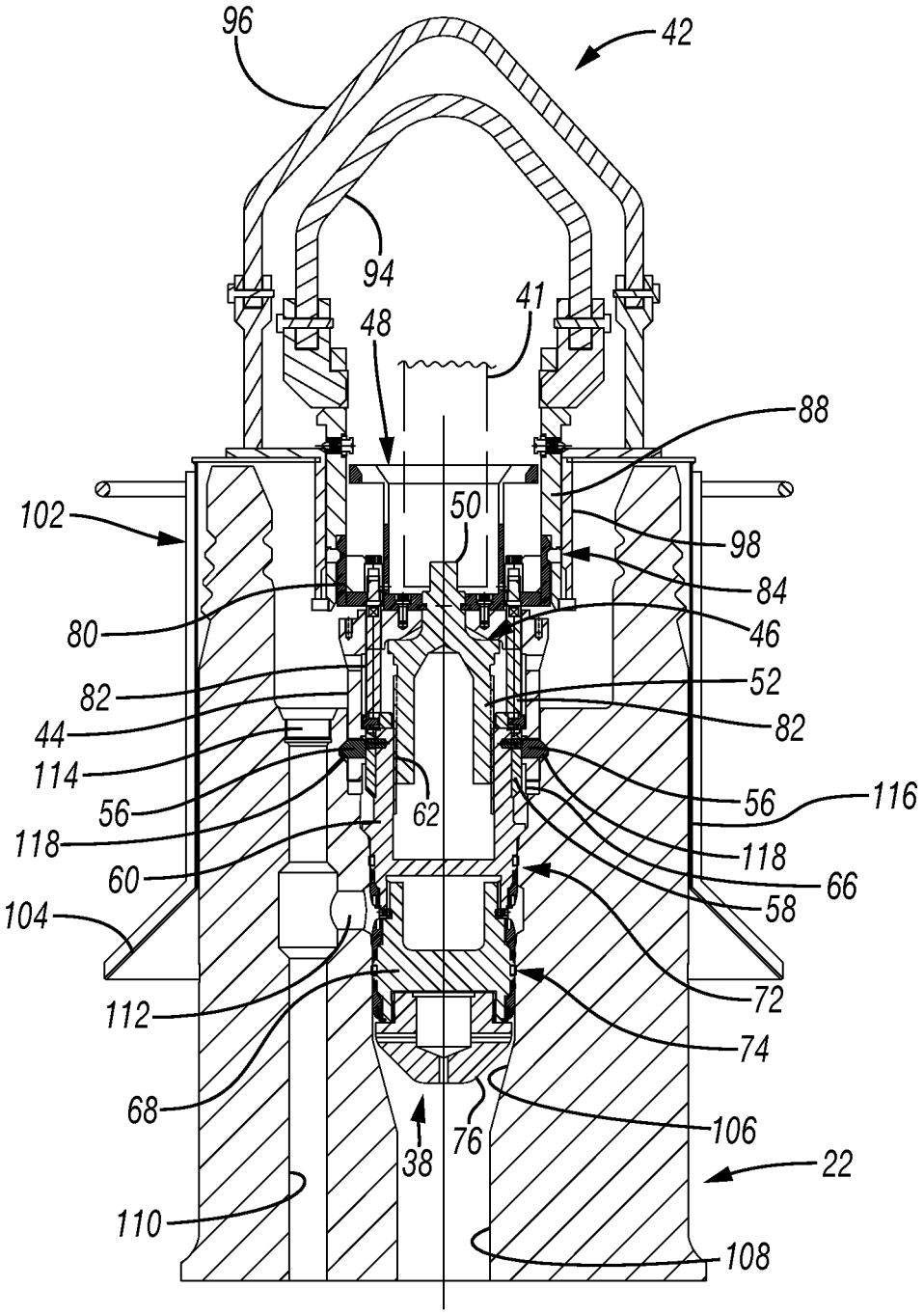
FIG. 5 is an illustration similar to that of FIG. 4 but during a different stage of deployment, according to an embodiment of the disclosure.

In FIG. 4, the tree cap 38 is illustrated as landed on subsea tree 22 while remaining unlocked with the seals 72, 74 not yet set. The external guide funnel 102 is sized to slide along an external region 116 of subsea tree 22 so as to guide the tree cap 38 into proper engagement within the subsea tree 22. Once the tree cap 38 is landed in tree cap receiving area 106, as illustrated in FIG. 4, the ROV manipulator 41 of ROV 40 may be coupled with ROV interface 50, as illustrated in FIG. 5. In FIG. 5, the tree cap 38 is illustrated as landed and locked and the seals 72, 74 are set. It should be noted the bail system 92 may be pivotably mounted, as illustrated, to enable easier access to ROV interface 50. The ROV manipulator 41 is used to rotate the ROV operated mechanism 46, e.g. power screw 52, while outer body 44 is held rotationally stationary by engagement features 66. The engagement features 66 and the outer body 44 enable sufficient application of torque to ROV interface 50 so as to set the seals 72, 74 and to lock the tree cap 38 to the subsea tree 22.

When power screw 52 is rotated relative to primary seal mandrel 60 along threaded engagement region 62, the locking member 58 and the primary seal mandrel 60 are moved linearly with respect to the power screw 52. This linear motion causes the locking member 58 to move against locking dogs 56 and to force the locking dogs 56 outwardly into a mating profile 118, e.g. groove or other recess, of subsea tree 22. Once the locking dogs 56 are forced into the mating profile 118, the tree cap 38 is locked into the subsea tree 22.

Continued rotation of power screw 52 causes continued linear movement of primary seal mandrel 60 and secondary seal mandrel 68 until seal 72 and seal 74 are properly positioned within tree cap receiving area 106. For example, the seal 72 may be moved to a desired position above the crossover port 112 while the seal 74 is moved to a position below the crossover port 112. In this example, the lower seal 74 provides a barrier between the production passage 34/108 and the annulus passage 36/110 when the well is flowing. The upper seal 72 provides a secondary barrier to the produced fluids when the well is flowing. The configuration of subsea tree 22 provides the subsea tree 22 with a concentric geometry in which seals 72, 74 provide two seal regions along the inside diameter of subsea tree 22. The configuration of subsea tree 22 and the positions of seals 72, 74 cooperate to block escape of fluids from both the production passage 34 and the annulus passage 36 while allowing communication between the production passage 34 and the annulus passage 36.

Figure 6:
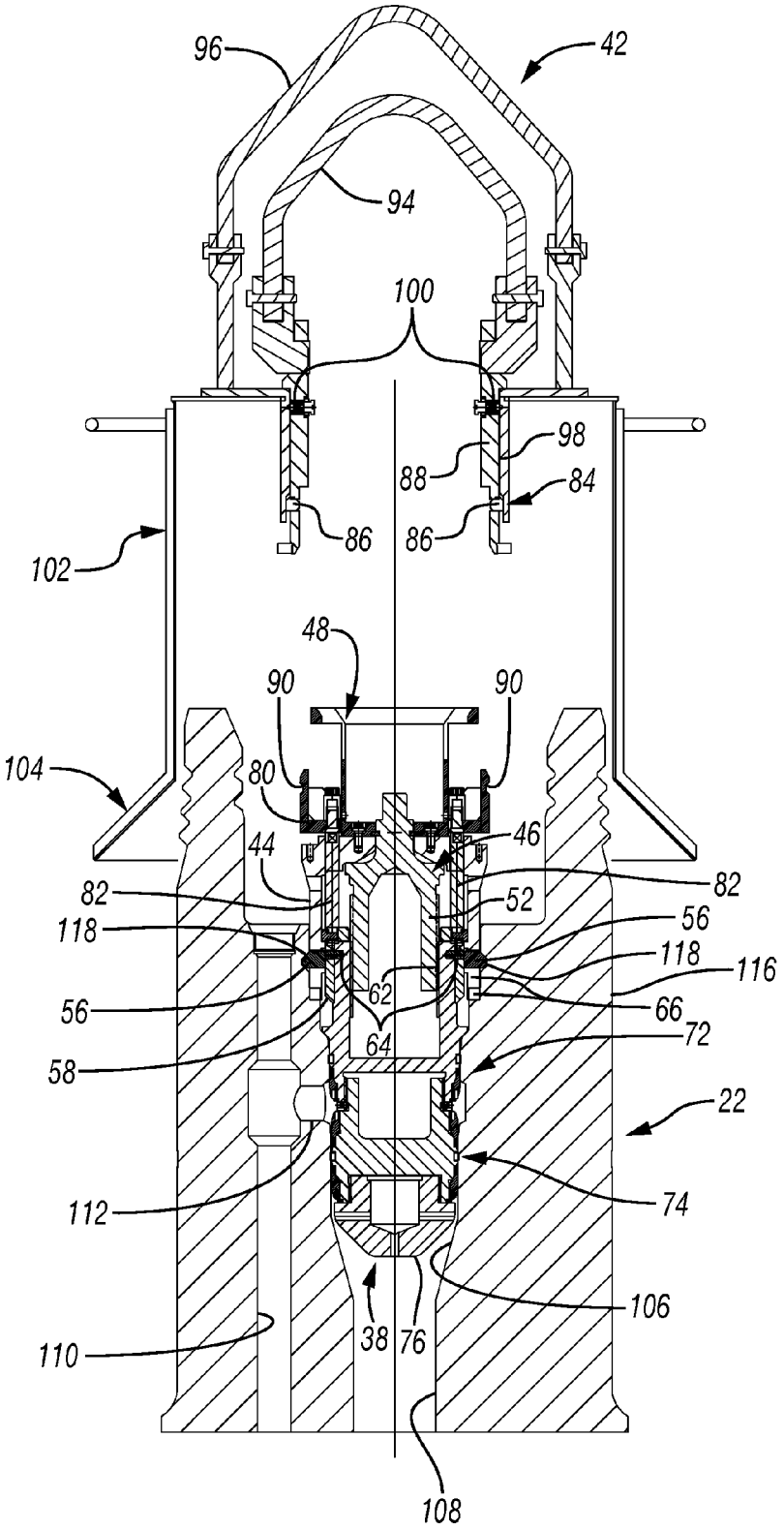
FIG. 6 is an illustration similar to that of FIG. 5 but during a different stage of deployment, according to an embodiment of the disclosure.

Referring generally to FIG. 6, the tree cap installation and retrieval assembly 42 is illustrated being retrieved. The assembly 42 may be released from tree cap 38 by lifting on external bail 96 with, for example, ROV 40. Lifting external bail 96 causes outer assembly housing 98 to move with respect to assembly housing 88 until pins 86 are released from the corresponding features 90 formed in tree cap 38. Consequently, the tree cap installation and retrieval assembly 42 is released from the tree cap 38 for removal via ROV 40 or by another suitable mechanism.

Additionally, the tree cap 38 may be released from subsea tree 22 by reversing the direction of rotation of ROV operated mechanism 46, e.g. power screw 52. The reverse rotation causes the locking member 58, e.g. locking actuator ring, to disengage from locking dogs 56. When the tree cap 38 is subsequently lifted for removal, the locking dogs 56 are forced inwardly to enable removal of the tree cap 38 from the subsea tree 22. If, for some reason, reverse rotation of mechanism 46 is not available, the secondary override system 78 may be utilized to remove the tree cap 38 from the subsea tree 22.

Figure 7:
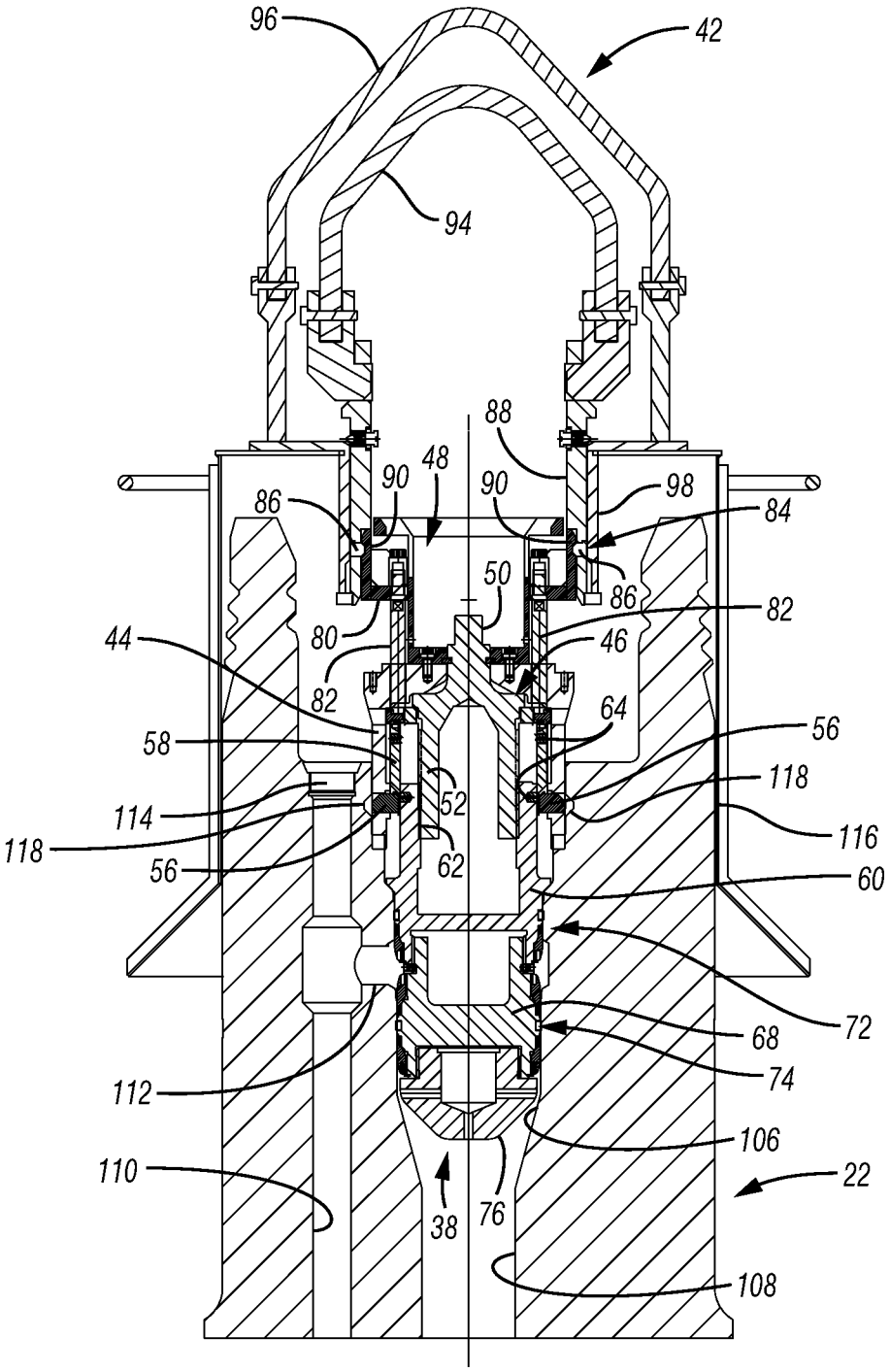
FIG. 7 is an illustration similar to that of FIG. 5 but showing a retrieval technique, according to an embodiment of the disclosure.

To utilize the override system 78 for unlocking and retrieving tree cap 38 (see FIG. 7), sufficient pulling force is applied to inner bail 94 while outer assembly housing 98 maintains pins 86 in engagement with corresponding features 90. The pulling force is directed through coupling mechanism 80, through override rods 82, and applied to locking member 58. Sufficient pulling force causes shearing of the shear member 64, e.g. shear pins, so that locking member 58 may slide relative to primary seal mandrel 60 until locking dogs 56 are released, as illustrated in FIG. 7. Once the locking dogs 56 are released, the tree cap 38 may simply be lifted from subsea tree 22 and retrieved to, for example, the surface.

Depending on the specifics of a given well application, the components of subsea tree 22, tree cap 38, and tree cap installation and retrieval assembly 42 may vary. For example, the subsea tree 22 may comprise various components and arrangements of production passages and annulus passages and may have a mono bore or dual bore configuration. Similarly, the tree cap 38 may comprise various types of ROV operated mechanisms 46, mandrels 60 and/or 68, seal systems 72, 74, override system 78, and/or other components or component configurations. The installation and retrieval assembly 42 also may comprise various types of bail systems 92, guide funnels 102, and/or other components to facilitate installation and retrieval of the tree cap 38.

Additionally, various techniques and equipment may be employed for installing and retrieving the tree cap 38. In some applications, the tree cap 38 may be deployed solely by ROV 40. However, other applications may use a buoyancy material to facilitate handling of the tree cap 38 and assembly 42 via the ROV 40. The tree cap 38 also may be installed with assistance from a wire or other suspension mechanism in an open sea. According to some embodiments, the tree cap 38 may be installed using a drill pipe running tool in a riser. Accordingly, various types of tools may be used alone or in cooperation with ROV 40 to facilitate installation and retrieval of the tree cap 38.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a subsea well application, comprising:

a subsea tree having a tree cap receiving area in communication with a production passage and with an annulus passage via a crossover port in the subsea tree; and a tree cap sized for receipt by the tree cap receiving area for removable engagement with the subsea tree, the tree cap comprising:

a locking feature selectively actuated to lock the tree cap to the subsea tree;

an ROV operated mechanism interacting with the locking feature to enable locking and unlocking of the tree cap via a remotely operated vehicle (ROV);

an upper sealing mandrel coupled with the ROV operated mechanism;

a lower sealing mandrel coupled with the upper sealing mandrel; and a seal system positioned to provide a desired flow isolation with respect to the production passage and the annulus passage when the tree cap is engaged and locked with respect to the subsea tree, wherein the seal system comprises an upper seal on the upper sealing mandrel and a lower seal on the lower sealing mandrel, the upper seal being located above the crossover port and the lower seal being located below the crossover port when the tree cap is fully inserted into the tree cap receiving area.

2. The system as recited in claim 1, wherein the locking feature comprises a plurality of locking dogs acted on by a locking member engaged with the ROV operated mechanism.

3. The system as recited in claim 2, wherein the ROV operated mechanism comprises a power screw coupled to the locking member and an ROV interface oriented for operative engagement with the ROV, the power screw being rotatable by the ROV to actuate the locking feature.

4. The system as recited in claim 3, wherein the upper seal and the lower seal are moved to desired sealing locations via rotation of the power screw by the ROV.

5. The system as recited in claim 4, wherein the tree cap further comprises a shear member which is sheareable by applying sufficient pull force to the tree cap, thus releasing the tree cap from the subsea tree without rotation of the power screw.

6. The system as recited in claim 1, further comprising a tree cap installation and retrieval assembly coupled to the tree cap via a release mechanism, wherein the tree cap installation and retrieval assembly comprises an external guide funnel oriented to externally engage the subsea tree and to guide the tree cap into the tree cap receiving area.

7. A system, comprising:

a subsea tree cap having locking features and a seal system operatively coupled with an ROV operated mechanism, the ROV operated mechanism comprising an ROV interface oriented for engagement with and rotation by an ROV, the rotation of the ROV interface in a given direction causing the ROV operated mechanism to actuate the locking features and shift the seal system, the seal system comprising seals located at two different positions along the subsea tree cap so as to sealingly engage an inside surface of a production passage in a subsea tree when the subsea tree cap is inserted into the subsea tree, the two different positions being selected to block flow from an annulus crossover port, in communication with an annulus passage in the subsea tree, into the production passage.

8. The system as recited in claim 7, wherein the locking features comprise a plurality of locking dogs acted on by a locking member engaged with the ROV operated mechanism.

9. The system as recited in claim 8, wherein the ROV operated mechanism comprises a power screw coupled to the locking member and to the ROV interface, the power screw being rotatable by the ROV.

10. The system as recited in claim 9, further comprising the subsea tree having a tree cap receiving area to receive the subsea tree cap, the subsea tree comprising the production passage and the annulus passage in communication with the tree cap receiving area.

11. The system as recited in claim 10, wherein the subsea tree cap further comprises a shear member which is shearable by applying sufficient pull force to the subsea tree cap so as to release the subsea tree cap from the subsea tree without rotation of the power screw.

12. The system as recited in claim 10, further comprising a tree cap installation and retrieval assembly coupled to the tree cap via a releasable mechanism.

13. The system as recited in claim 12, wherein the tree cap installation and retrieval assembly comprises an external guide funnel oriented to externally engage the subsea tree and to guide the subsea tree cap into the tree cap receiving area.

14. A method, comprising:

positioning a subsea tree at a subsea well;

providing a production flow passage and an annulus flow passage in the subsea tree;

positioning a crossover port in communication with the production flow passage and the annulus flow passage;

moving a tree cap via an ROV into position in a tree cap receiving area of the subsea tree;

using the ROV to lock the tree cap into position in the tree cap receiving area; and using seals positioned above and below the crossover port when the tree cap is locked into position to prevent fluid flow along the production flow passage and to prevent fluid flow between the annulus flow passage and the production flow passage via the crossover port, wherein using the ROV comprises using the ROV to rotate a power screw of the tree cap to both engage a locking mechanism and to move the seals into a position providing a sealed region with respect to the production flow passage and the annulus flow passage.

15. The method as recited in claim 14, further comprising using the tree cap as a debris cap.

* * * * *